United States Patent [19]

Stenberg

[11] 4,445,974

[45] May 1, 1984

[54] APPARATUS FOR FORMING A MULTILAYER JET OF PAPER MAKING STOCK

[75] Inventor: Erik G. Stenberg, Karlstad, Sweden

[73] Assignee: Aktiebolaget Karlstads Mekaniska Werkstad, Karlstad, Sweden

[21] Appl. No.: 266,174

[22] Filed: May 22, 1981

Related U.S. Application Data

[63] Continuation-in-part of Ser. No. 210,781, Nov. 26, 1980, abandoned, which is a continuation of Ser. No. 31,409, Apr. 19, 1979, abandoned.

[30] Foreign Application Priority Data

Apr. 25, 1978 [SE] Sweden ..... 7804729

[51] Int. Cl.[3] ..... D21F 1/06

[52] U.S. Cl. ..... 162/300; 162/303; 162/317; 162/322; 162/343; 162/344; 162/347

[58] Field of Search ..... 162/123, 212, 213, 214, 162/317, 322, 343, 344, 347, 192, 303, 300, 301

[56] References Cited

U.S. PATENT DOCUMENTS

| | | | |
|---|---|---|---|
| 3,923,593 | 12/1975 | Verseput | 162/343 |
| 4,070,238 | 1/1978 | Wahren | 162/347 |
| 4,141,788 | 2/1979 | Justus | 162/347 |

*Primary Examiner*—Peter Chin

*Attorney, Agent, or Firm*—Brumbaugh, Graves, Donohue & Raymond

[57] ABSTRACT

Multilayer headbox apparatus for a papermaking machine comprises spaced apart headbox walls defining an elongated, converging channel terminating in an exit opening, and at least one partition member anchored in the headbox at its upstream end with its downstream end free, said partition member extending from side to side in the headbox and at least to the vicinity of said opening and dividing the headbox into a plurality of shallow, converging channels extending to said opening for conveying a plurality of paper making stocks thereto and for discharging a plurality of paper making stocks therefrom in stacked, spaced apart relation, together with means for maintaining a wedge-shaped body of gaseous fluid between said discharged jets at the downstream end of said partition member to keep the jets separated for a predetermined distance beyond said exit opening in the direction of a forming surface.

28 Claims, 26 Drawing Figures

APPARATUS FOR FORMING A MULTILAYER JET OF PAPER MAKING STOCK

BACKGROUND OF THE INVENTION

This application is a continuation-in-part of application Ser. No. 210,781 filed Nov. 26, 1980, abandoned, which, in turn, is a continuation of application Ser. No. 31,409, filed Apr. 19, 1979 (now abandoned).

The present invention relates to apparatus for forming a stratified, multilayer jet of paper making stock for use in the production of a multilayer paper web.

Stratified jets of paper making stock have been produced in the past by forming a plurality of stock flows in superimposed, spaced apart relation and continuously delivering the superimposed strata at substantially equal velocities through at least one slice opening and substantially in a common direction of flow to a forming zone in a paper making machine.

Also, U.S. Pat. No. 3,352,748 discloses a cylinder type machine for producing a two ply web of fibrous material in which separate webs are formed on a screen cylinder and on a screen belt partly surrounding the cylinder, and hot, compressed air or steam is introduced between the two webs thus formed to squeeze water out of them, after which they are pressed together into a common layer.

SUMMARY OF THE INVENTION

It is an object of the invention to provide new and improved apparatus for producing a stratified jet of paper making stock capable of creating a multilayer web comprising a plurality of distinct layers intermingled only at the adjoining layer surfaces.

This is accomplished, according to the invention, by discharging a plurality of superimposed jets of stock in spaced apart relation to each other from at least one slice opening, keeping the discharged jets separated for part of the distance between the slice opening and the forming zone where drainage should begin, and thereafter, but not later than the arrival of the jets at the forming zone, allowing the superimposed jets to come into direct contact with each other. Preferably, the discharged jets are kept separated by maintaining between them wedge-shaped volumes of gas such as air, for example.

The invention is based on the realization that intermingling between the discharged fibrous layers is dependent on the time that the layers are in contact with each other before drainage starts, as well as on the level of the turbulence existing in the adjacent meeting layer surfaces. It enables the mixing time to be shortened as desired simply by keeping the fibrous layers separated physically as they travel in a direction towards the forming surface. Further, damping of the turbulence level in the layer surfaces is possible, and the mixing effect during said mixing time can be reduced.

Broadly, the invention contemplates mounting at least one rigid or flexible partition member in a slice chamber of a multi-ply headbox for creating a plurality of stacked, spaced apart jets of stock to be discharged from at least one slice opening. The partition member has a downstream end located substantially at the slice opening of the slice chamber. At least the downstream end of the partition is comparatively thick. Upon starting, an air wedge is initially formed at the downstream end of the partition and, as the jets entrain air from the wedge, a gaseous medium, such as air, is supplied to the wedge to prevent it from collapsing. The discharged jets are kept separated by means of the gaseous wedge thus formed, and by adjusting the negative pressure in the wedge, the jets can be brought together before or upon arrival at the forming zone in such controlled manner (the same negative pressure is acting on both jets for the same period of time) as to produce a clean, multi-strata jet in which the strata are not intermingled to an unacceptable extent.

When the stock flows along a comparatively long partition member, e.g. where the partition member extends out of the slice opening a substantial part of the distance to the forming surface, a gas such as air may be introduced into the boundary layer, according to the invention, to reduce any frictional drag on the stock caused by the partition member. This embodiment is of particular utility where the partition member is thin. The air or other gas can be introduced at the upstream end of the partition member via a small porous pipe extending in the cross-machine direction, for example.

DESCRIPTION OF REPRESENTATIVE EMBODIMENTS

For a better understanding of the invention, reference is made to the following description, taken in conjunction with the accompanying drawings, in which.

Figure 3:
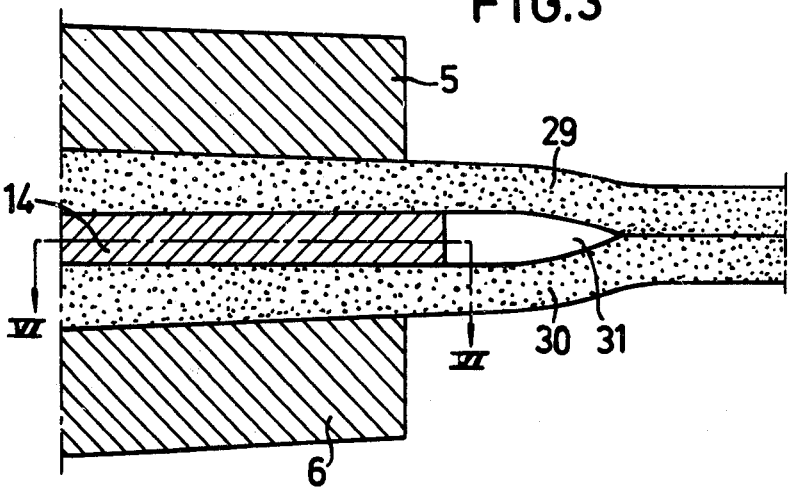
FIG. 3 is an enlarged side view in section similar to FIG. 2, illustrating another embodiment of the invention.
Figure 5A:
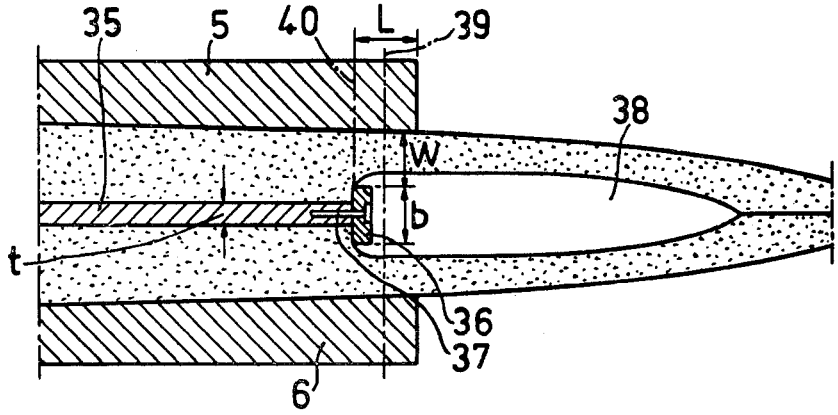
Figure 5B:
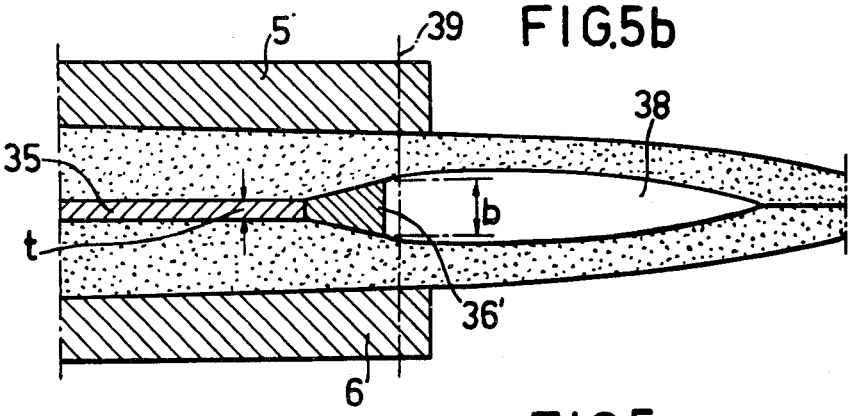
Figure 5C:
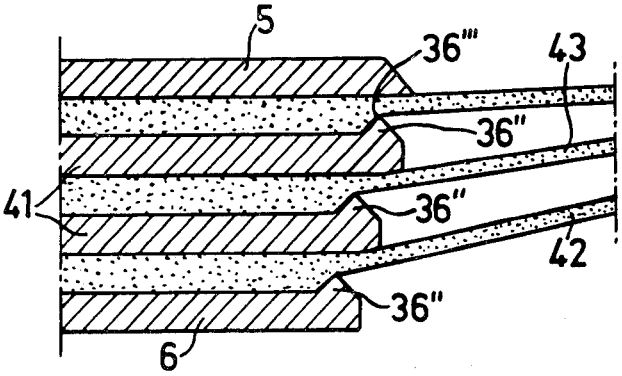
Figure 6A:
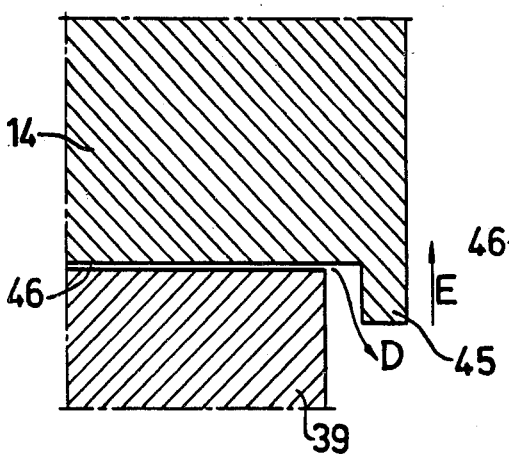
Figure 6B:
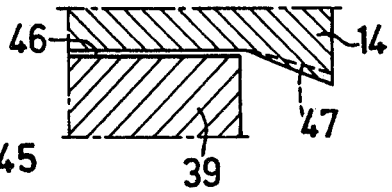

FIGS. 5*a*, 5*b* and 5*c* illustrate schematically three further embodiments of the invention;

FIG. 6*a* is a view in section taken along the line VI—VI in FIG. 3 and looking in the direction of the arrows;

FIG. 6*b* shows schematically a modification of the apparatus illustrated in FIG. 6*a;*

Figure 1:
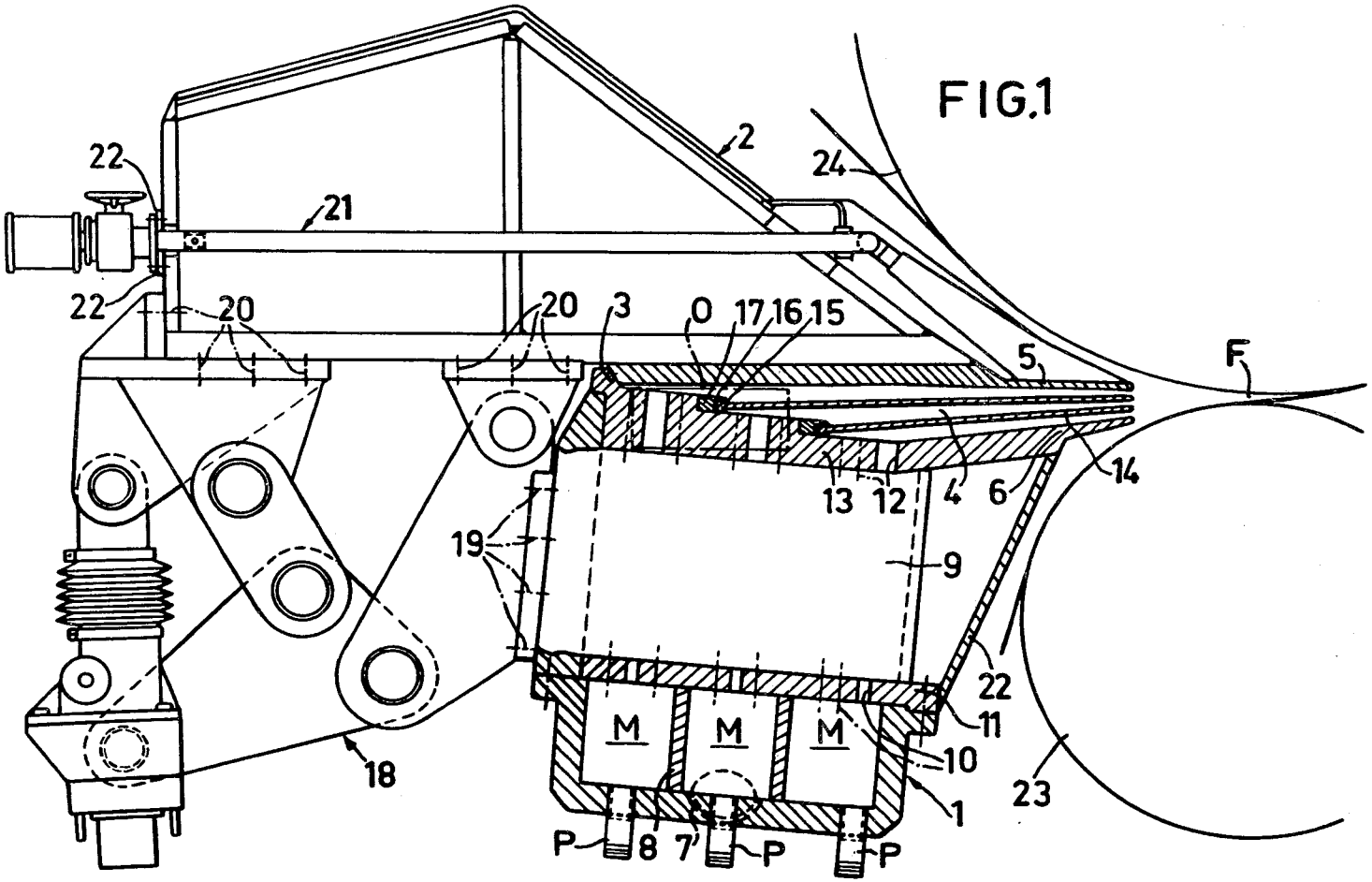
FIG. 1 is a side view partially in section of a headbox constructed according to the invention, having two partition members arranged in the headbox slice chamber.
Figure 8:
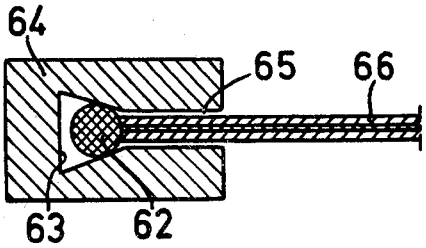
Figure 9:
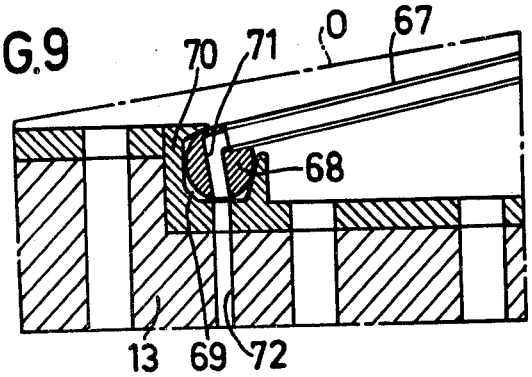
Figure 9A:
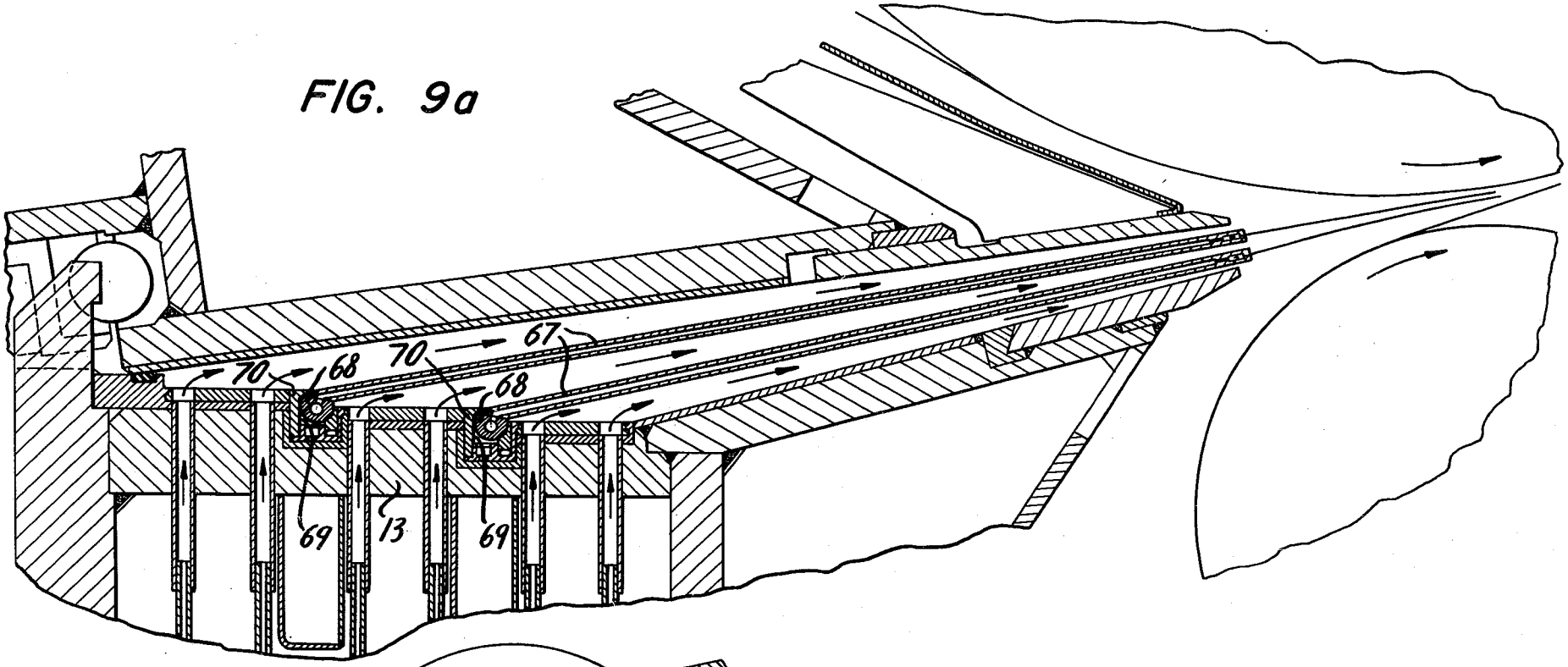
Figure 9D:
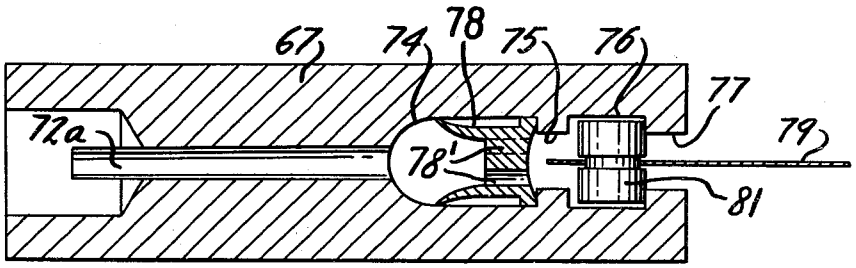
Figure 9C:
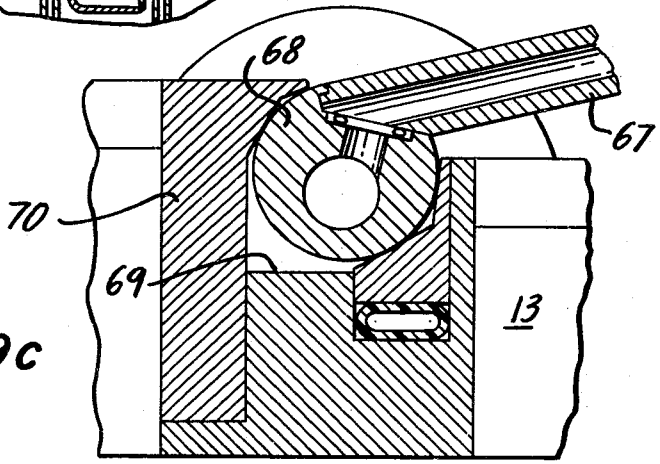
Figure 9B:
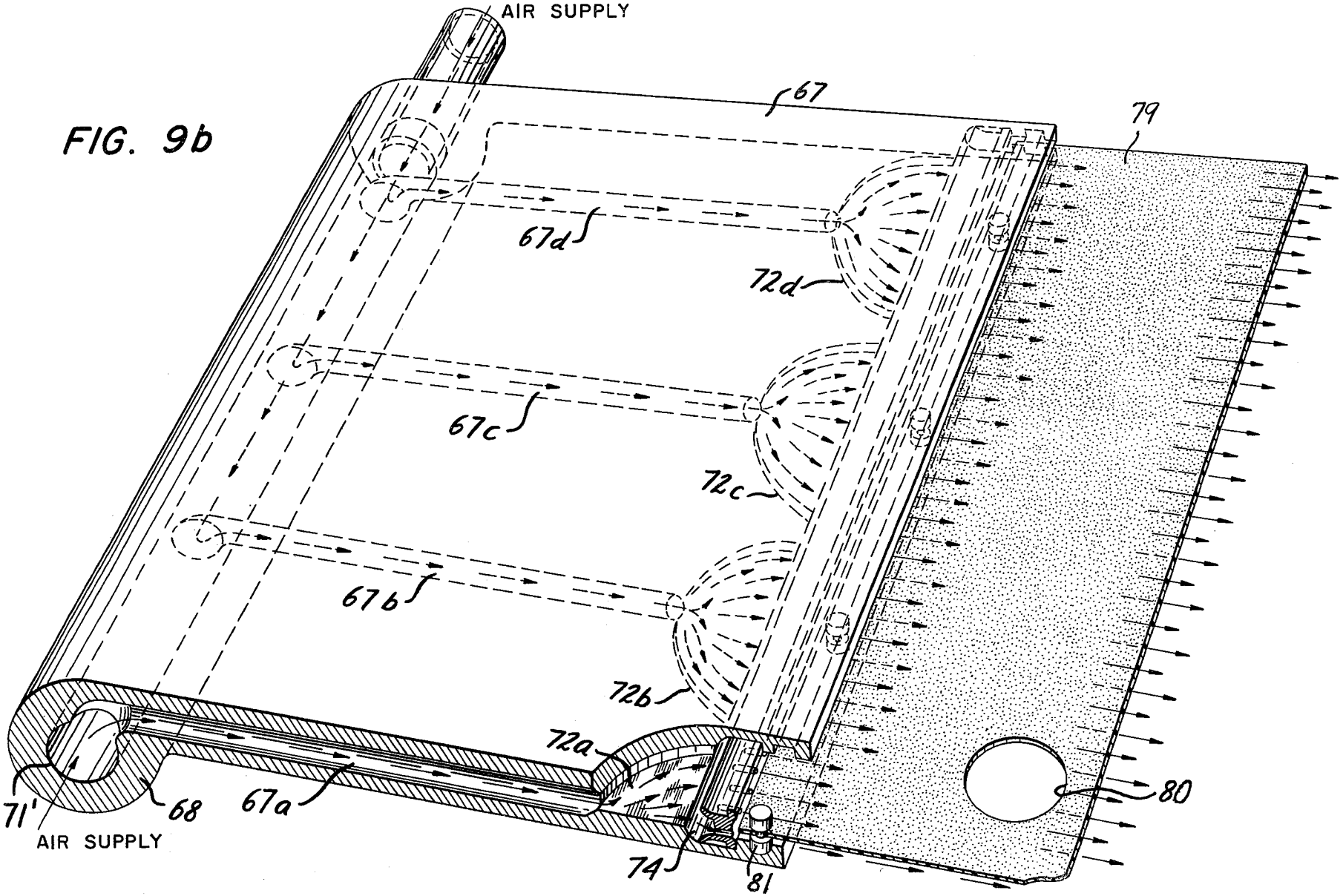

FIGS. 7*a*, 7*b*, 7*c*, 7*d*, and 7*e* show in section the downstream ends of different forms of headbox partition members that may be employed according to the invention;

FIG. 8 is a partial view in section showing another form of partition member together with means for attaching its upstream end to the headbox;

FIG. 9 is an enlarged view of the area O in FIG. 1 illustrating an alternative way of attaching the upstream end of the partition member to the headbox;

FIG. 9*a* is a partial view in section of a headbox utilizing a preferred form of partition member;

FIG. 9*b* is a perspective view partly in section of the partition member shown in FIG. 9*a;*

Figures 9E, 9F:
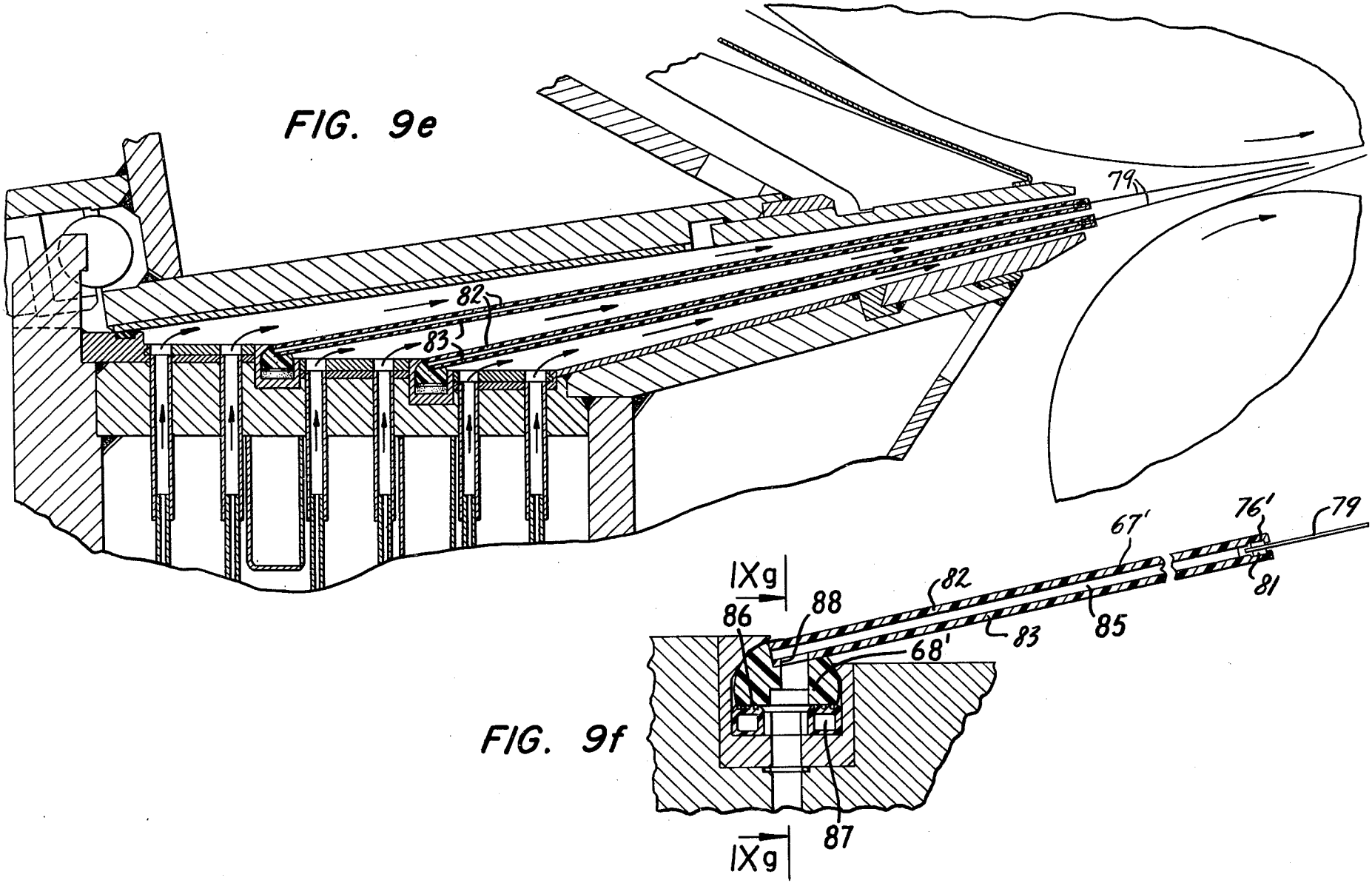

FIG. 9*c* is an enlarged view of the upstream end of the partition member in FIG. 9*a* illustrating how it is attached to the headbox;

FIG. 9*d* is a side view in vertical section of the downstream end of the partition member of FIG. 9*a* with a jet separating foil affixed thereto;

FIG. 9*e* is a partial side view of a headbox incorporating another preferred form of partition member constructed according to the invention;

FIG. 9*f* is an enlarged, sectional side view of one of the partition members shown in FIG. 9*e;*

Figure 10:
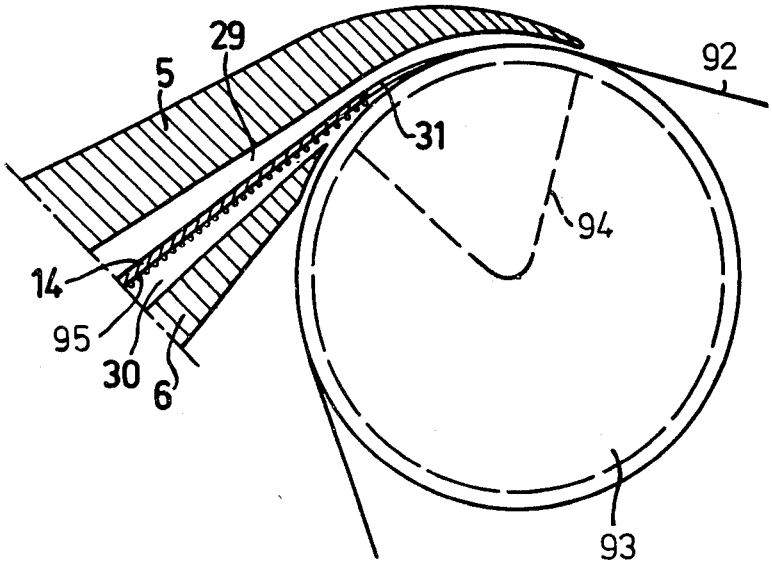
Figure 9G:
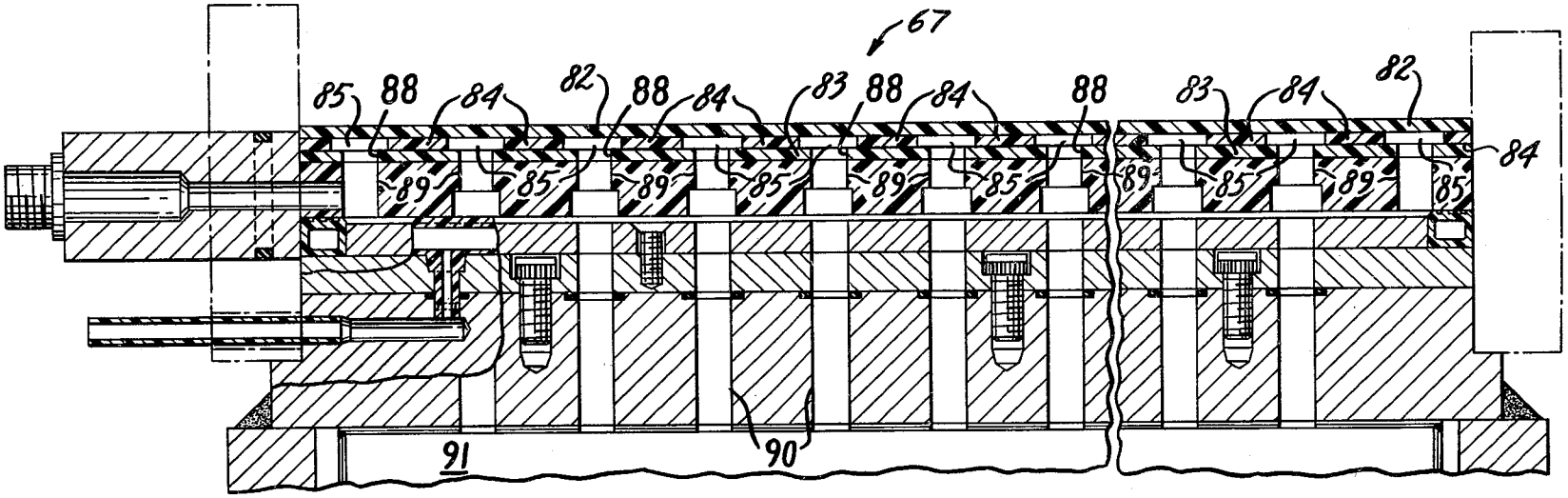
Figure 9H:
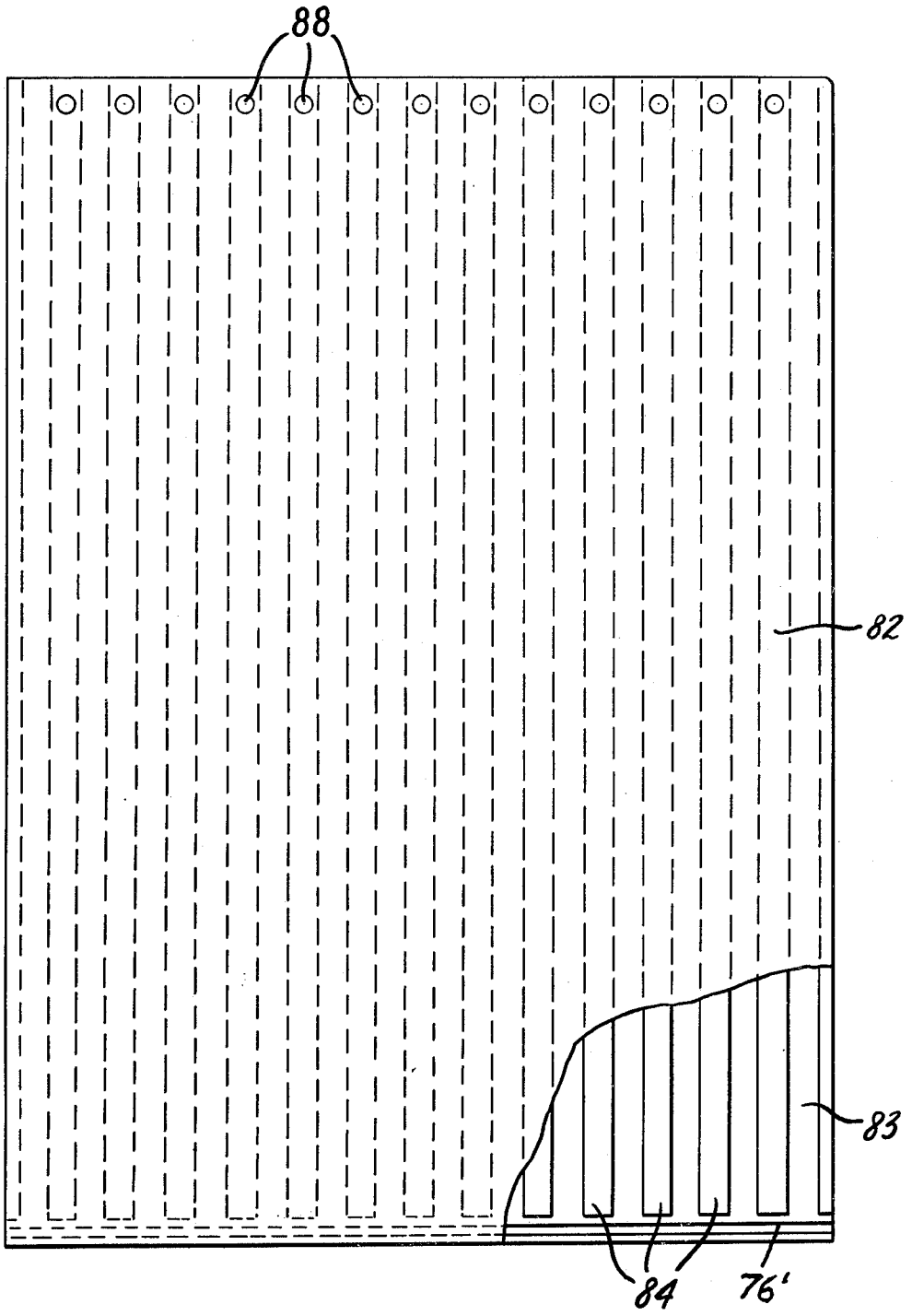

FIG. 9*g* is a view in section taken along the line IX-g—IXg of FIG. 9*f* looking in the direction of the arrows;

FIG. 9*h* is a plan view of a partition member of the kind shown in FIGS. 9*e*, 9*f* and 9*g*; and FIG. 10 is a schematic diagram of a further embodiment of the invention incorporated in a breast roll former.

The headbox shown in FIG. 1 comprises a bottom portion 1 and a top portion 2 sealingly joined together to form between them a channel 4 having a top lip 5 and a bottom lip 6. The positions of the bottom portion 1 and the top portion 2 may, of course, be reversed.

Three stocks are flowed separately through the headbox to form a three-layer stock jet which is discharged from the channel 4. Each stock enters a mixing chamber M through a pipe P. Alternatively, the stocks can enter the mixing chambers M through side pipes, only the pipe 7 for the middle chamber being shown in dotted lines in FIG. 1. The mixing chambers M are separated by intermediate walls 8 and extend from one side of the machine to the other for uniform distribution of stock across the machine direction. Moreover, in the side inlet embodiment, the cross-sectional area of each mixing chamber M diminishes continuously from the inlet end at one side of the machine to its outlet end at the other side, and part of the stock flow can be recirculated through the outlet end, all in the known manner.

From the mixing chambers M, the stocks flow through a stock flow aligning device 9 of the kind disclosed in U.S. Pat. No. 4,225,386 of Karl Göran Edblom et al., comprising a plurality of tubes (not shown) connected at their upstream ends to holes 10 in an upstream tube plate 11 and at their downstream ends to holes 12 in a downstream tube plate 13. As shown in FIG. 1, the holes 12 can be larger than the holes 10. Also, the tubes are formed such that cross flow tendencies in the stocks are substantially eliminated.

From the stock flow aligning device 9, the stocks flow through three slice chambers formed in the channel 4 by a plurality of partition members 14 disposed between its top lip 5 and its bottom lip 6, so that three separate flows are discharged with nearly the same discharge velocity. As shown in FIG. 1, the upstream end 15 of each of the partition members 14 is hinged in a groove 16 formed in suitably shaped strips 17 secured to the downstream tube plate 13. The partition members 14 extend almost perpendicular to the axes of the holes 12 in the plates 13 so that the stocks flowing through the latter are turned almost through a right angle into the slice chambers formed by the partition members 14.

FIG. 1 also shows a power actuated linkage system 18 attached to the bottom headbox portion 1 by suitable fastening means 19 and to the top headbox portion 2 by suitable fastening means 20 for setting the slice opening. For fine adjustment of the slice opening profile in the cross-machine direction, the top lip 5 is attached to a power actuated linkage system 21 secured to the top headbox portion 2 at 22. These setting systems do not constitute any part of the present invention and are therefore not described in detail. The headbox is also provided with a front inclined wall 22*a* to reinforce the headbox structure. The headbox is adapted to discharge a multilayer stock jet to a forming surface F at a throat defined by inner and outer wires adapted to run over a breast roll 23 and a forming roll 24 in the usual manner.

The headbox shown in FIG. 1 is typical of many different designs of headboxes, which after modification as described herein can be used to practice the invention. In the figures described below, therefore, only parts necessary for illustrating the invention have been shown, and those parts have been shown to an enlarged scale for the sake of clarity.

Figure 2:
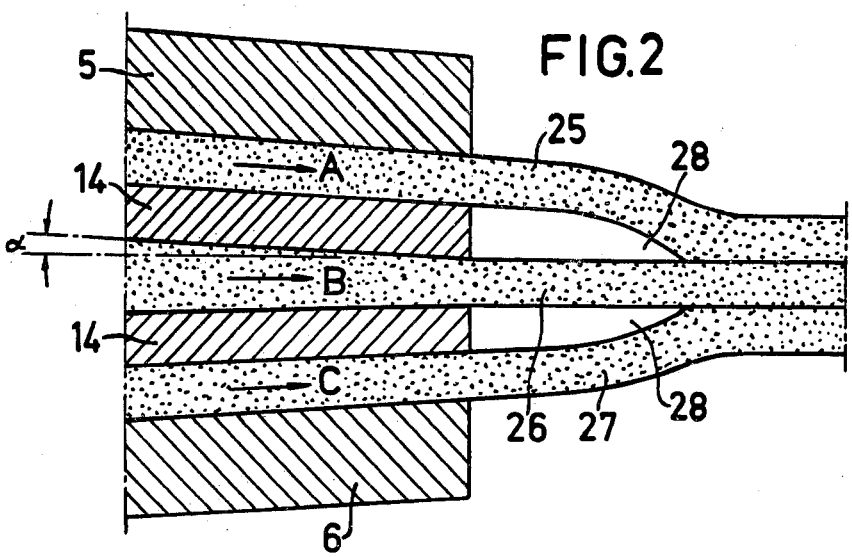
FIG. 2 is a side view in section of only the downstream part of the slice chamber shown in FIG. 1 to a larger scale.

As shown in FIG. 2, three separate stocks flow in the directions indicated by arrows A, B and C, one between the two partitions 14, one between the top lip 5 and the adjacent partition 14, and the third between the bottom lip 6 and the nearby partition 14. According to the invention, the discharged layers of stock 25, 26, 27 are kept separated after they have left the slice openings, and the separation continues in a direction towards and in some cases as far as at least one forming surface (not shown) on which the web is to be formed, where drainage begins. In this manner, a multilayer fibrous web having distinct layers is formed.

Preferably, the stocks are kept separated by maintaining between them wedges 28 formed of a gas such as air, for example. This affords a simple way of automatically setting the stock jets for each operational case, i.e., for each given jet velocity and jet thickness. Further simplification can be achieved by utilizing as the gas air from the ambient atmosphere that is admitted from the sides relative to the stock jets. By using a gas to separate the discharged jets of stock, the separated distance of the jets from the place where discharged to the place where they meet can be simply controlled by regulating the negative pressure of the gas.

The gas is conveyed out of each wedge at its tip and settles in the form of small bubbles in the boundary layer between the two adjacent stock jets. Gas for forming and maintaining the wedge can be supplied in several ways. Thus, air or other gas can be introduced at the downstream end of each partition member. In this case, for example, air from the ambient atmosphere can be drawn in from the sides due to a slight vacuum in the wedge. Air or other gas can also be supplied at or even somewhat before the lower surface of the upstream end of each partition member, whereby the gas flows in the form of bubbles with the stock along the partition member to its downstream end. Controlled delivery of gas for adjustment of the length of the wedge can be effected with either upstream or downstream supply. Different kinds of gas supply will be further described below.

As shown in FIG. 2, there is a convergence angle $\alpha$ between the partition members 14 and also a corresponding convergence angle between the partition members 14 and the adjoining slice lips 5 and 6, respectively. This convergence angle should be as small as possible and can suitably be about 2°–6°.

The length of the wedge can be calculated. For example, with a stock jet velocity of 700 m/min, a partition thickness of 10 mm, a stock jet thickness of 5 mm, and free air admission from both sides, the estimated length of the air wedge will be about 200 mm and the air pressure in the wedge about 170 Pa lower than the pressure of the ambient air. These values are in good agreement with measurements taken in practice. The boundary surfaces of the wedge are parabolic in shape, as can be established by calculation, and as shown greatly exaggerated in FIG. 2.

A suitable wedge may also be created by stock in the foamed state, which can be allowed to flow into a headbox between two intermediate walls that separate the flow of foamed stock from stock flowing outside the walls, i.e., a three-layer headbox of the kind shown in FIG. 1. In this case, partition members in the slice chamber are preferably tapered, at least at the slice outlet, to allow pressure recovery and deceleration of the foam. After discharge from the slice opening and initial separation of the three layers by gas wedges, the stock in foamed state will keep the discharged layers of non-foamed stock from mixing.

In all of the embodiments described below, it is assumed that a gas wedge, preferably an air wedge, has been created.

In the embodiment illustrated in FIG. 3, two stocks flow through a headbox slice and are separated by one partition member 14. The discharged stock layers 29 and 30 are kept separated by means of a wedge 31. As shown in FIG. 3, the partition member 14 preferably terminates beyond the end surface of the slice lips 5 and 6 in order to govern the jets 29 and 30. The slice sides (not shown) preferably terminate in the area between the end surfaces of the slice lips and the end surface of the partition member.

Figure 4:
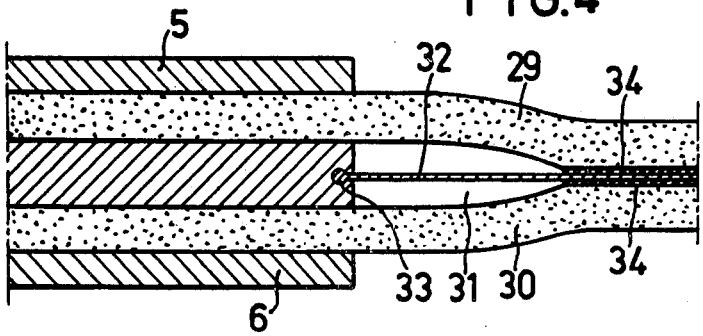
FIG. 4 illustrates yet another embodiment of the invention.

FIG. 4 shows a further embodiment in which a thin leaf 32 such as a polyester sheet of less than 1 mm thickness, suitably 0.3 to 0.4 mm for example, and of substantially the same width as the partition, is attached to the downstream edge 33 of the partition member and extends centrally into the wedge 31 to keep the layers of stock 29 and 30 separated. The air forms a boundary layer 34 of small bubbles on each side of the leaf. The leaf 32, which is turbulence damping and self-adjustably flexible throughout its length, provides positive separation of the layers and the air-wedge and air-filled boundary layers minimize friction.

While the partition members are straight in the embodiments described above, a partition member can be made curved at its downstream end portion. Also, its thickness need not be uniform as in FIGS. 1–4 but, as shown in FIG. 5*a*, it may comprise a narrower partition 35 having an edge piece 36 attached at the downstream edge thereof, by means of screws 37, for example. The edge piece 36 creates a thicker and, thus, longer air wedge 38 downstream thereof. The thickness of the partition member is designated by t in FIG. 5*a* and the corresponding dimension of the edge piece is designated by b. As shown in FIG. 5*a*, b is greater than t.

The embodiment of FIG. 5*a* offers the advantage of a less exacting tolerance on the straightness of the partition member since the velocity of the stock flows in the slice will be lower. Further, it is easier to make a straight edge piece than a straight partition member of uniform thickness. In addition, it results in a gas wedge that will be thicker and therefore longer due to the contraction of each jet caused by the edge piece 36.

The slice lips 5 and 6 in FIG. 5*a* can extend past the downstream end of the partition member 35, 36 to control the direction of the jets of stock discharged through the slice opening. Also, the ends of the slice sides terminate at the location indicated by the chain-dotted line 39, after the jets have reached full contraction. The chain-dotted line 40 indicates the earliest slice side termination substantially coinciding with the inner surface of the edge piece 36. The distance between the end surfaces of the slice lips 5 and 6 and the inner surface of the edge piece 36 is indicated by L, and the distance between the top or bottom surface of the edge piece 36 and the inner surface of the top or bottom lip 5 or 6 is indicated by W. For good control of the jets, L/W should be $\geqq 1$.

In FIG. 5*b*, the partition member 35 is provided with an edge piece 36' which enlarges continuously up to the downstream end, e.g. is wedge-shaped as shown. Still another embodiment is shown in FIG. 5*c* incorporated in a three-jet slice chamber. The end of the bottom lip 6 as well as the ends of the partition members 41 are formed with laterally extending cams 36'', each of which tapers upwardly to an edge 36'''.

In the embodiments shown in FIGS. 1 through 3, 5*a*, 5*b* and 5*c*, the thickness of the downstream edge of the partition and of the edge piece, respectively, should be comparatively large, e.g. at least about 6 to 8 millimeters, so as to produce a long gaseous wedge. In the embodiment shown in FIG. 1, stainless steel sheets of a uniform thickness of 12 mm have given excellent results, but it is also possible to substitute plastics or glass, for example, for the stainless steel, provided such partitions have uniform thickness at the downstream edge to a high degree and are free from such surface irregularities as are harmful to an acceptable formation of the web and from skewness or similar distortions that are detrimental to a uniform web profile in the cross-machine direction.

To obtain the optimum conditions for forming a multilayer fibrous web, the discharge velocities of the separated stocks should be at least substantially equal. In addition, where the slice lips terminate and the slice outlet is located, the pressure of the stock should be equal to the pressure of the atmosphere. Also, by using end pieces like those shown in FIGS. 5*a*, 5*b* or 5*c*, it is possible to create air wedges so thick and stable that the pressure in the wedge becomes very nearly atmospheric if it is open to the atmosphere at one or both sides of the headbox. In this extreme but quite practical case, the two, three or even more jets of stock emerging from the headbox are not really interdependent by the action of the pressure in the enclosed air wedges between the jets but can be regarded as independent jets of stock emitted from the same headbox at substantially the same velocity.

While in FIGS. 2, 3, 4, 5*a* and 5*b* the lips 5, 6 are shown extending outwardly for an equal distance, the top lip 5 of the slice can be made longer than the bottom lip 6, as shown in FIG. 5*c*, or vice versa, in order to control the direction of the flow of stock. Also, the partition members 14 in the embodiment of FIG. 2 for three separated stock flows preferably should both extend through the slice outlet, one preferably a greater distance than the other, as shown in FIG. 5*c*. Under such conditions, the directions of the jets coming out of the headbox are stable and determined by the direction of the flow defining surface located most downstream of the slice opening for each jet. Also, with a slice having only one partition member 14, as in FIG. 3, the partition member can be allowed to project out of the slice a selected distance towards the forming surface, in order to control the direction of the common stock jet and also to bring the wedge nearer to the forming surface. An example of a partition member that terminates upstream of the slice outlet is described below with reference to FIG. 10.

As best shown in FIG. 6*a*, the partition member 14 of the embodiment illustrated in FIG. 3 has a laterally projecting shoulder 45 which is arranged in such manner that stock flowing at the side of the partition member (i.e., in the clearance 46 between the partition member and the slice outer side wall 39) will splash out sideways, in the direction of the arrow D, and thus will not disturb the intake of air (arrow E) beyond the outer end of the partition member for forming and maintaining the wedge. The opposite outer corner of the partition member can be made in the same way. Alternatively, and even for a partition member without a shoulder or other projection, the slice end wall located opposite the end wall 39 can extend past the partition member 14 and form a sealed end, air being admitted to the wedge from one side only. In the embodiments shown in FIGS. 5*a*, 5*b* and 5*c*, the edge pieces 36, 36' and 36" can be provided with lateral projections to serve the same purpose as the shoulder 45 in FIG. 6*a*.

FIG. 6*b* shows another form of downstream corner for the partition member 14 in which the partition member is tapered laterally outwardly at the outer end and has a V-shaped groove 47 formed in the side of the tapered portion. Another alternative is a flexible seal between the side wall and the partition member having a dimension in the direction of the thickness of the partition member corresponding to the thickness of the latter.

Figure 7A:
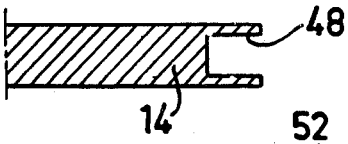

FIG. 7*a* shows an alternative form of partition member having a recessed, straight groove 48 formed in its outer end. Such a groove can also be formed by fastening two narrow, strip-shaped sheets (not shown) at the downstream end of the partition member. Alternatively, two strips (not shown) can be fixed to the free edge portions of the groove 48 so as to extend towards each other, leaving an open slot between them, or the free edge portion can be formed with such strips. Air or other gas can be supplied to the groove 48 laterally from one side thereof. Also, a pipe having holes throughout its length or along its middle portion can be disposed in the groove 48 for supplying air or other gas thereto. In the event the air supplied by self-suction is not sufficient to produce a wedge of the desired length, a suitable forced delivery gas source may be provided.

Figure 7B:
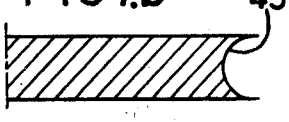
Figure 7C:
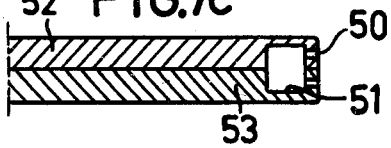

In FIG. 7*b*, the partition member has a rounded groove 49, and FIG. 7*c* shows a further embodiment in which holes 50 arranged in one or more rows communicate with a laterally extending duct 51 formed in the end of the partition member as shown. The partition member in FIG. 7*c* can be made of two sheets 52 and 53 joined together as shown. Air for forming and maintaining the wedge can be drawn in by self-suction from one or both sides. Air or other gas can also be supplied in a controlled manner (forced supply) in order to reduce the vacuum in the wedge and thereby increase the length of the wedge in a direction towards the forming surface.

In the embodiment shown in FIG. 7*c*, it is essential that the gas pressure be nearly equal all along the duct 51 and that the gas be uniformly emitted from the holes 50. Partition members having grooves or ducts in the outer ends enable larger quantities of air to be drawn in by self-suction because the cross-sectional area of the wedge is enlarged by the size of the groove. As a result, a substantially longer wedge can be obtained than with partition members of the kinds shown in FIGS. 2–4, 5*a*, 5*b* and 5*c*, without the need for forced delivery of air.

Figure 7D:
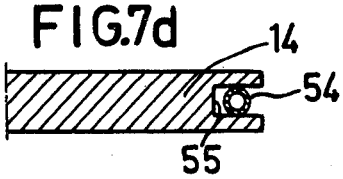
Figure 7E:
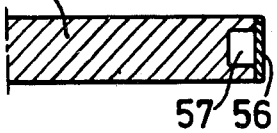

FIG. 7*d* shows a partition member having a recess 55 formed therein in which is disposed a pipe 54 for supplying gas. The pipe 54 may be made of suitable porous material, through which gas bubbles can pass in a suitably controlled manner for forming a wedge of a desired length. In FIG. 7*e*, a strip 56 of porous material covers a recess in the edges of the partition member and forms a duct 57 therewith through which gas is supplied. In these forms of the invention, it is essential, as in the case of FIG. 7*c*, that nearly the same internal pressure be maintained along the entire length of the pipe 54 or the duct 57.

If desired, gas emission devices of the kind shown in FIGS. 7*d* and 7*e* can also be disposed upstream of the downstream edge of the partition member, e.g. at the upstream end of a partition member and preferably at the place where it is attached inside the headbox. In this wise, a curtain of bubbles are emitted to the underside of the partition member, which gas bubbles flow with the stock along the partition member to its downstream end, where they form a gas wedge.

The partition member 14 can be made of a material that provides a rigid or a somewhat flexible wall. Where it is desired that a rigid partition member be capable of pivoting movement, the partition member can suitably be mounted in the slice so that there is a small clearance 46 (FIG. 6*a*) between it and each of the two adjacent side walls 39 (only one of which is shown in FIG. 6*a*) of the headbox. This assures that the wall will not be damaged when the partition member turns around its fulcrum as it adjusts its position to achieve the same discharge velocity in each of the stock flows. With more flexible partition members made of plastic or reinforced rubber, for example, a pivoted attachment is not necessary.

In FIG. 8, the fastening for the partition member is different from that shown in FIG. 1. Here, the partition member is fastened at its upstream end to a bar 62 (FIG. 8) of the same or other material, which is pivotably movable in a groove 63 formed, for example, in an element 64 fixed to the downstream tube plate 13 (FIG. 1). The groove 63 is of generally triangular cross-section and it communicates at its apex with a straight slot 65, in which the upstream end of the partition member is slightly movable. The partition member may be made of flexible material, such as rubber for example, in which laterally parallel wires 66 have been encased. In this manner, the partition member has flexibility across its length in the slice, i.e., in the cross-machine direction, but also has a certain degree of rigidity in the machine direction to avoid fluttering. As an alternative to wires, other material such as a thin metal plate, for example, can be used.

FIG. 9 illustrates another form of partition member and mounting means for the upstream end thereof. The partition member 67 is attached at its upstream end by suitable means such as screws, for example, to a bar 68 which is pivotally movable in a groove formed in or at the downstream tube plate 13, for example a groove 69 formed in a profiled strip 70 attached to the tube plate.

A number of substantially parallel channels extend in the machine direction within the partition member 67 from its upstream end to its downstream end. These channels communicate with at least one channel 71 formed in the bar 68, and this channel in turn communicates with a channel 72 extending through the downstream tube plate 13 to the space between the tubes (not shown) in the aligning device 9. Sealing means such as a plastic bushing, for example, can be provided between the downstream end of the channel 72 and the upstream end of channel 71. Preferably, a channel 71 and a channel 72 are provided for each channel in the partition member.

The space between the tubes in the aligning device 9 communicates with an air (or other gas) source positioned outside the headbox, suitable valve means being provided for controlling the air pressure in the space and thereby the pressure in the air wedge. By this means, a very good air distribution can be obtained across the machine direction and sufficient air is assured for obtaining the desired length of the air wedge even in very wide machines.

FIGS. 9*a*, 9*b* and 9*c* illustrate a preferred form of headbox in which a plurality of vertically spaced partition members 67 are attached at their upstream ends by suitable means such as screws, for example, to a plurality of bars 68, respectively. Each bar 68 is pivotally mounted in or on the downstream tube plate 13, for example, in a groove 69 formed in a profiled strip 70 attached to the tube plate in a manner similar to that shown in FIG. 9.

As shown in FIG. 9*b*, a number of substantially parallel channels 67*a*, 67*b*, 67*c* and 67*d* extend in the machine direction within each partition member 67 from its upstream end to its downstream end. These channels communicate with a channel 71′ formed in the bar 68 and extending in the cross-machine direction. The channel 71′ may communicate at one or both ends with an air (or other gas) source positioned outside the headbox, suitable valve means (not shown) being provided for controlling pressure of the air supplied thereto.

At their downstream ends, the channels 67*a*, 67*b*, 67*c* and 67*d* communicate with a plurality of shallow chambers 72*a*, 72*b*, 72*c* and 72*d*, respectively, each suitably shaped to permit the gas to fan out as it approaches the downstream end of the partition member 67. From the downstream ends of the chambers 72*a*, 72*b*, 72*c* and 72*d*, the gas enters a channel 74 that extends in the cross-machine direction. The downstream end of the channel 74 communicates through a slot 75 (FIG. 9*d*) with another channel 76, which also extends in the cross-machine direction, and from which a stream of gas is discharged through a slot 77 to form the air wedge at the downstream end of the partition member 67.

Within the channel 74 is disposed suitable means for insuring that the gas for the air wedge is uniformly distributed in the cross-machine direction. Typically, such gas distributor means may comprise an extruded synthetic resin strip 78 shaped to fit snugly within the channel 74 and provided with a plurality of small holes 78′ extending in the machine direction, for directing the gas to the slot 75. Preferably, the holes 78′ are made small enough in diameter and suitably shaped and so positioned as to insure an even air distribution in the cross-machine direction through the slot 75. Also, desirably the air supplied should reach sonic velocity in the holes 78′.

If desired, each partition member 67 may be provided at its downstream end with a foil of the kind shown in FIG. 4. The foil 79 (FIGS. 9*b* and 9*d*) may be made of a plastic material marketed under the trade name Melinex, for example, and it may be, say, 0.35 mm in thickness. Desirably, one or more holes 80 should be formed in the foil 79 so as to equalize the air pressure in the air wedges on opposite sides thereof during operation of the headbox.

To facilitate easy attachment and removal of the foil 79 at the downstream end of the partition member 67, the foil 79 has secured at its upstream end a plurality of dowels 81 spaced apart in the cross-machine direction. The dowels 81 are suitably sized and shaped so as to be readily received within the channel 76 at the downstream end of a partition member 67, and to position the foil 79 approximately midway between the top and bottom of the channel 76. By feeding the dowels 81 into the channel 76, the foil 79 can easily be moved in the cross-machine direction until it is properly positioned, as shown in FIG. 9*b*. Similarly, by sliding the dowels 81 out of the channel 76, the foil 79 can easily be removed.

By virtue of the headbox structure shown in FIGS. 9*a*, 9*b*, 9*c* and 9*d*, a very good air distribution can be obtained across the machine direction and sufficient air is assured for obtaining the desired cross-machine width of the air wedge even in very wide machines. Also, the length of the wedge from the downstream end of a partition member to the location where the adjacent surfaces of the jets come together can be varied over a range by control of the pressure of the gas supplied to the wedge.

Desirably, the slice side walls in such machines should extend ahead of the downstream end of the partition member or members in order to shield against ambient air, so that no or very little air is supplied to the air wedge from the sides, whereby a uniform air wedge length along the whole machine is assured. Moreover, lateral holes may be provided in the walls between the channels in the partition member for pressure equalization therein.

In another preferred embodiment of the invention, a partition member provided with channels in the machine direction as described above can be produced, for example, by joining together two thin sheets made of a suitable material such as fiberglass reinforced plastic, with parallel strips between the sheets extending from the upstream end to the downstream end, as shown in FIGS. 9*e*, 9*f*, 9*g* and 9*h*. When joined together by a suitable adhesive, for example, the strips form the channels therebetween.

Thus, the partition member 67′ in this embodiment comprises upper and lower thin sheets 82 and 83 of a suitable material such as fiberglass reinforced plastic having a plurality of narrow, parallel, spaced apart strips 84 sandwiched between them. The strips 84 and the upper and lower sheets 82 and 83 are joined together by a suitable adhesive and form a plurality of narrow channels 85 extending from the upstream to the downstream end of the partition member 67′. If desired, the sheets 82 and 83 may be covered with thin stainless plate.

At the downstream end, the partition member 67′ is provided with a slot 76′ (FIGS. 9*f* and 9*h*) extending in the cross-machine direction which is suitably shaped to receive snugly the dowels 81 mounted at the upstream end of a foil 79. Good air distribution is achieved in this embodiment without the necessity for the flow controlling holes in FIG. 9*d*. The partition member 67′ is secured at its upper end to a bar 68′ (FIG. 9*f*) much in the same way that the partition member 67 in FIG. 9*a* is secured to the bar 68. The bar 68′ has a flat bottom 86 resting on an inflatable support and seal 87 which extends thereunder for the entire cross-machine distance. The support 87 may be maintained inflated at the desired pressure by a controllable source of gas under pressure (not shown).

At the upstream end of the partition member 67′ are formed a plurality of openings 88 which provide communication between the downstream end of each of the channels 85 in the partition member 67 and a plurality of downwardly extending bores 89 in the bar 68' which communicate through a plurality of conduits 90 with a duct 91 in the flow aligning device 9 (FIG. 1). The duct 91 communicates with an air (or other gas) source (not shown) positioned outside the headbox, suitable valve means being provided for controlling the air pressure in the space and thereby the pressure in the air wedge.

If the multilayer headboxes shown in FIGS. **9–9*h*** are operated without a supply of gas under pressure to form the air wedge, the entrainment of gas by the jets will cause the negative pressure between the jets to increase. Under these conditions, atmospheric pressure acting on the outside surfaces of the jets will bend them inwardly until they come into contact. When this occurs, undesirable violent jet instability occurs and the jets explode. With an air wedge maintained in place as described above, however, the jets are entirely stable and, by controlling the gas pressure in the wedge, it is possible to keep the jets separated for as much as eight inches from the slice opening in the direction of the forming surface.

When actively feeding air through the partition member to the downstream end thereof, in order to form and maintain an air wedge, as shown in FIGS. 9, **9*a* and 9*e***, it is also possible to utilize the air as a carrier for atomized solid or liquid particles to be incorporated in the web. The particles may be chemically inactive additives such as clay, talc, $TiO_2$ and similar fillers, pigments or dyes, or chemically active additives such as wet strength agents.

The partition member or members can also be rigidly connected to the headbox or possibly adjustably mounted therein. In such case, each slice opening can be adjusted separately for separate stock flow by controlling the top and/or bottom lip and/or the positions of the partition members by well-known, simple, manually operated control means located exteriorly of the headbox. Thus, the top lip 5 in FIG. 1 can be controlled by the power actuated linkage system 21.

This makes it possible to operate with slightly different velocities in the different layers, in order to adjust the sheet properties in the different layers. In principle, each layer can then be considered to be enclosed in its own headbox. However, it should be noted that different flow quantities in the different layers can be accommodated in all arrangements by control of the flow in each layer by means of valves, pump speed, etc.

FIG. 10 illustrates schematically how the invention can be applied to a so-called breast roll former. As in the case of FIG. 3, two stocks flow through a headbox slice separated by a partition member 14, and the layers of stock 29 and 30 discharged therefrom are kept separated after they have left the partition member by means of a wedge 31 extending towards the forming surface, which here is a wire 92 running over a breast roll 93 and provided in a known way with at least one suction zone 94, for example.

In the breast roll former, the slice terminates in principle where the bottom (rear) slice lip 6 terminates, while the downstream part of the top (front) lip 5 is shaped to provide a surface to guide the stock. In this case there is one fixed guiding surface, i.e., the top lip 5, and one movable forming surface formed by the wire 92. Desirably, the top lip 5 should be pivotally mounted by means (not shown) to permit it to be set in a selected position suitable for forcing the stock against the wire 92. Drainage takes place through the wire 92 and into the breast roll 93, assisted by the suction device 94 in the breast roll.

It is also possible to produce a multilayer jet according to the invention by means of at least two conventional headboxes, possibly unified to form a super headbox, each delivering a jet to a common forming surface. The jets should be substantially parallel to each other or should converge slightly towards each other, depending on the spacing between them at the locations where they are discharged from the headboxes. During their travel through a substantial part of the distance to the common forming surface, the jets are kept separate from each other by ambient atmosphere in the manner described above and are independent of each other.

While the invention has been illustrated in FIGS. 1, **9*a*, 9*e* and 10** as applied to a specific typical web forming apparatus (i.e., a twin wire former), the apparatus of the invention can, of course, also be utilized with other types of forming surfaces and sheet forming machines such as machines having a Fourdrinier wire section, for example.

The invention is, of course, not limited to the embodiments described above and illustrated in the drawings herein but is susceptible of modification in form and detail within the scope of the following claims.

I claim:

1. A multilayer headbox for delivering a stratified sheet-like jet to a forming surface of a paper making machine comprising spaced apart headbox walls defining an elongated, converging channel terminating in an exit opening, at least one partition member anchored in the headbox at its upstream end with its downstream end free and extending at least to the vicinity of said opening, said partition member extending from side to side in said channel and dividing the headbox into a plurality of shallow, converging channels extending to said opening for conveying a plurality of paper making stocks thereto and discharging a plurality of sheet-like jets of paper making stocks therefrom, in which the improvement comprises at least one partition member having a downstream end formed so that the jets of paper making stock are discharged from said opening in stacked, spaced apart relation, with a gap therebetween, together with means for maintaining a wedge-shaped body of gaseous fluid in the gap between said discharged jets of paper making stock at the downstream end of said partition member to keep the jets separated for a predetermined distance beyond said opening in the direction of said forming surface.

2. Apparatus as claimed in claim 1 in which the partition member is movable in response to pressure difference between the opposite sides thereof.

3. Apparatus as claimed in claim 2 in which the partition member is relatively rigid, at least in the direction of its length.

4. Apparatus as claimed in claim 2 in which the partition member is relatively flexible, at least transversely of the direction of its length.

5. A multilayer headbox as defined in claim 3 or claim 4, together with means for supplying gaseous fluid to said gaseous fluid body maintaining means to control the pressure in the said body of gaseous fluid as gaseous fluid is entrained between the jets and withdrawn therefrom.

6. Apparatus as claimed in claim 5 in which the gaseous fluid supplying means comprises means establishing fluid communication between at least one lateral end of said body of fluid and ambient atmosphere.

7. Apparatus as in claim 5 in which the partition member has an end face disposed substantially normal to the direction of its length.

8. Apparatus as claimed in claim 7 in which a longitudinal groove is formed in the end face of the partition member.

9. Apparatus as claimed in claim 7 in which the partition member is enlarged in thickness at its downstream edge so as to produce a thicker and therefore longer body of gaseous fluid.

10. Apparatus as claimed in claim 1 together with a flexible sheet of substantially the same width as the partition member and having an upstream edge anchored to the downstream edge of the partition member, said sheet being thin as compared with the partition member and extending from said slice opening part of the distance to said forming surface through and beyond said gaseous fluid body to maintain the ribbon-like jets separated beyond the downstream end of said body of fluid.

11. Apparatus as claimed in claim 1 together with a flexible sheet of substantially the same width as the partition member and having an upstream edge anchored to the downstream edge of the partition member, said sheet being thin as compared with the partition member and extending from said slice opening part of the distance to said forming surface to maintain the ribbon-like jets separated after delivery through said slice opening.

12. Apparatus as claimed in claim 5 in which the gaseous fluid supplying means comprises means defining a duct in the partition member, said duct having a gas permeable wall portion extending transversely of the partition member, and means for supplying gaseous fluid to said duct.

13. Apparatus as claimed in claim 5 in which the supplying means comprises means forming channels within the partition member extending longitudinally thereof from its upstream to its downstream end and means is provided placing the upstream ends of said last-named channels in communication with a source of a gaseous fluid.

14. Apparatus as claimed in claim 13 in which the upstream end of said partition member is pivotally mounted in the headbox by pivot means extending transversely thereof and having an axially extending conduit therein communicating with the upstream ends of said channels in the partition member, said conduit communicating at at least one end thereof with a source of a gaseous fluid.

15. Apparatus as claimed in claim 14 in which the partition member has at its downstream end a laterally extending gaseous fluid discharge slot and the downstream ends of said channels in the partition member fan outwardly to distribute said gaseous fluid over the length of said slot.

16. Apparatus as claimed in claim 15 in which fluid distributor means is disposed in said slot for discharging therefrom a flow of gaseous fluid that is substantially uniform along the length thereof.

17. Apparatus as claimed in claim 16 in which said fluid distributor means comprises laterally extending wall means in said slot having formed therein a plurality of small, uniformly distributed openings directed to discharge gaseous fluid longitudinally of the partition member.

18. Apparatus as claimed in claim 17 together with a flexible sheet of substantially the same width as said partition member and having an upstream edge removably anchored to the downstream edge of the partition member, said sheet being thin as compared with the partition member and extending from said slice opening a sufficient distance to maintain the discharged jets separated beyond the downstream edge of said wedge-shaped body of gaseous fluid.

19. Apparatus as claimed in claim 13 in which the partition member comprises upper and lower walls secured to a plurality of longitudinally extending, laterally spaced apart narrow strips forming therebetween a plurality of longitudinally extending channels for supplying the gaseous fluid.

20. Apparatus as claimed in claim 19 in which the partition member is made of reinforced plastic material.

21. Apparatus as claimed in claim 1 in which there are at least two, spaced apart partition members, each having a downstream end formed so that three superimposed jets of papermaking stock are discharged from said opening in stacked, spaced apart relation, with gaps therebetween, together with means for maintaining a wedge-shaped body of gaseous fluid in the gap between each pair of discharged jets of papermaking stock at the downstream end of each of said partition members to keep the jets separated for a predetermined distance beyond said opening in the direction of said forming surface.

22. Apparatus as claimed in claim 1 in which the partition member is rigid and extends a short distance out of the slice opening, and the fluid body maintaining means comprises laterally extending fluid discharge outlet means formed at the downstream end of the partition member and longitudinally extending channel means in the partition member and having upstream and downstream ends connected, respectively, to an inlet for gaseous fluid from a source and to said fluid discharge outlet means.

23. Apparatus as claimed in claim 23 together with a flexible sheet of substantially the same width as said partition member and having an upstream edge anchored to the downstream edge of the partition member, said sheet being thin as compared with the partition member and extending from the downstream end thereof a sufficient distance to maintain the discharged jets separated beyond the downstream edge of said wedge-shaped body of gaseous fluid.

24. Apparatus as claimed in claim 1 in which the partition member is rigid and is rigidly mounted in the headbox.

25. Apparatus as claimed in claim 1 in which the partition member is adjustably mounted in the headbox.

26. Apparatus as claimed in claim 1 in which said plurality of shallow, converging channels terminate in a plurality of slice openings through which the jets of paper making stock are discharged and control means is provided for adjusting at least the position of the partition member to adjust the slice openings separately for controlling the stock flows in said converging channels.

27. Apparatus as claimed in claim 26 in which the control means is located exteriorly of the headbox.

28. Apparatus as claimed in claim 21 together with a flexible sheet of substantially the same width as said partition member and having an upstream edge removably anchored to the downstream edge of the partition member, said sheet being thin as compared with the partition member and extending from said slice opening a sufficient distance to maintain the discharged jets separated beyond the downstream edge of said wedge-body of gaseous fluid.

* * * * *

UNITED STATES PATENT AND TRADEMARK OFFICE

CERTIFICATE OF CORRECTION

PATENT NO. :4,445,974

DATED :May 1, 1984

INVENTOR(S) :Erik G. Stenberg

It is certified that error appears in the above-identified patent and that said Letters Patent is hereby corrected as shown below:

Col. 14, line 37, "claim 23" should read --claim 22--;

Col. 14, line 60, "claim 21" should read "claim 19--.

Signed and Sealed this

*Eleventh* Day of *September 1984*

[SEAL]

*Attest:*

GERALD J. MOSSINGHOFF

*Attesting Officer*

*Commissioner of Patents and Trademarks*